US008485608B2

(12) United States Patent
Meier et al.

(10) Patent No.: US 8,485,608 B2
(45) Date of Patent: Jul. 16, 2013

(54) HEADING OR EXTRACTION MACHINE

(75) Inventors: Manfred Meier, Fohnsdorf (AT); Egmont Lammer, Knittelfeld (AT)

(73) Assignee: Sandvik Mining and Construction G.m.b.H., Zeltweg (AT)

( * ) Notice: Subject to any disclaimer, the term of this patent is extended or adjusted under 35 U.S.C. 154(b) by 198 days.

(21) Appl. No.: 12/998,276

(22) PCT Filed: Oct. 23, 2009

(86) PCT No.: PCT/AT2009/000415

§ 371 (c)(1),
(2), (4) Date: Apr. 5, 2011

(87) PCT Pub. No.: WO2010/048650

PCT Pub. Date: May 6, 2010

(65) Prior Publication Data

US 2011/0193398 A1 Aug. 11, 2011

(30) Foreign Application Priority Data

Oct. 28, 2008 (AT) ..... A 1679/2008

(51) Int. Cl.
*E21C 25/06* (2006.01)
*E21D 21/00* (2006.01)

(52) U.S. Cl.
USPC ..... 299/75; 299/11; 299/73; 405/148; 405/150.2

(58) Field of Classification Search
USPC ..... 299/11, 73, 74, 75, 29, 95; 405/146, 405/148, 150.1, 150.2
See application file for complete search history.

(56) References Cited

U.S. PATENT DOCUMENTS

| | | | | |
|---|---|---|---|---|
| 1,330,743 | A * | 2/1920 | Morgan | 299/65 |
| 3,647,262 | A * | 3/1972 | Kacmarcy | 299/11 |
| 4,077,670 | A | 3/1978 | Spies et al. | |
| 4,101,173 | A * | 7/1978 | Hodgkinson | 299/33 |
| 4,640,369 | A * | 2/1987 | Goyarts | 173/42 |
| 4,753,486 | A * | 6/1988 | LeBegue | 299/11 |
| 4,834,580 | A * | 5/1989 | Barendsen et al. | 405/138 |
| 6,315,496 | B1 * | 11/2001 | Hagedorn et al. | 405/150.1 |
| 2003/0111892 | A1 * | 6/2003 | Neilson et al. | 299/11 |
| 2005/0129466 | A1 * | 6/2005 | Walker et al. | 405/259.1 |

FOREIGN PATENT DOCUMENTS

| | | | |
|---|---|---|---|
| AT | 413 230 | B | 12/2005 |
| DE | 2 208 710 | | 9/1973 |
| DE | 26 21 674 | A1 | 11/1977 |
| DE | 31 03 694 | A1 | 9/1982 |
| DE | 103 46 583 | A1 | 5/2005 |
| DE | 10 2006 049 060 | A1 | 4/2008 |
| EP | 0 037 807 | A1 | 10/1981 |
| EP | 1 298 283 | A1 | 4/2003 |
| JP | 62-268492 | A | 11/1987 |
| WO | WO 88/09426 | A1 | 12/1988 |

* cited by examiner

*Primary Examiner* — David Bagnell
*Assistant Examiner* — Michael Goodwin
(74) *Attorney, Agent, or Firm* — Chapman and Cutler LLP

(57) ABSTRACT

In a heading or extraction machine (1) including extraction tools that are movable over the working face, and track walling devices such as anchor drilling and setting devices (9), the machine (1) comprises a platform (6) that is displaceable in the longitudinal direction of the machine and carries at least two track walling devices each mounted to be separately displaceable relative to the platform (6).

18 Claims, 5 Drawing Sheets

HEADING OR EXTRACTION MACHINE

The invention relates to a heading or extraction machine including extraction tools that are movable over the working face, and track walling devices such as anchor drilling and setting devices.

Heading or extraction machines of the initially defined kind have become known in various configurations. In accordance with the objective to secure the driven track against tumbling material, different track securing and track walling devices have been proposed, depending on the nature of the respective rock. From AT-413230 B, a heading machine including an anchor platform that is displaceable in the longitudinal direction of the machine has become known, on which at least two anchor drilling and setting devices are pivotally supported in the front. It is thus possible to move the anchor drilling and setting devices for setting anchors into a position close to the working face, while achieving a safe support of the anchor drilling and setting devices owing to the movable anchor platform. After having set the anchors, the anchor drilling and setting device can be moved back again together with the anchor platform to such an extent as to prevent a collision with the cutter bar. In order to ensure a safe support of the anchor platform in the position advanced to the working face, it is proposed in AT-413230 B that the anchor platform cooperates with a slide bearing provided on the cutter arm of the heading and extraction machine, at least in its front region.

From EP-1298283 A1, a tunnelling machine is, moreover, known, in which a portal-like machine frame is provided, which constitutes a device that is separate from the tunnelling machine and supported on the floor in a manner displaceable on rails. The machine frame, which overlaps the tunnelling machine in a portal-like manner, carries various means for securing the rock space, such as anchor drilling and setting devices, working platforms for manipulating roof support systems or support grids, as well as local shotcrete manipulators. In that case, the machine frame can be trailed by the heading machine by the aid of a traction means.

EP-037807 A1 discloses a heading machine including a walling means that is displaceable on the heading machine by the aid of an auxiliary frame, wherein the cutter bar serves as an anterior support bearing.

When securing and walling a driven track, different types of securing and walling devices have to be provided as a rule, wherein, depending on the nature of the respective rock, shotcrete manipulators or devices for manipulating and positioning walling frames or arches are required in addition to anchor drilling and setting devices. Conventional heading or extraction machines will not fully meet these requirements, since the different types of track walling devices cannot be made available without supplementary apparatus. Thus, concrete mixing installations including shotcrete manipulators to be dragged by the heading or extraction machine, or separate manipulating devices for walling elements such as walling frames or walling arches, have, for instance, been proposed. The expenditures involved in track securing and walling measures will, however, be considerably increased when providing separate devices, wherein difficulties will arise due to the constricted space conditions in the walled track when taking walling measures also in a position immediately behind the working face.

The invention aims to improve a heading or extraction machine of the initially defined kind to the effect that it will also be possible to provide different track walling devices on the driving or extraction machine itself without using separate machines or supporting structures to be dragged behind, in order to enhance the flexibility, safety and efficiency of a track walling operation and also facilitate the work of the operating personnel.

To solve this object, the driving or extraction machine of the initially defined kind is essentially characterized in that the machine comprises a platform that is displaceable in the longitudinal direction of the machine and carries at least two track walling devices each mounted to be separately displaceable relative to the platform. By the machine comprising a platform that is displaceable in the longitudinal direction of the machine, it has become possible to mount suitable track walling devices on said platform, wherein the displaceability of the platform allows for appropriate positioning of the track walling devices. Said displaceability of the platform relative to the machine frame, in particular, enables the track walling devices to be positioned close to the working face such that the respective securing and walling measures can be performed directly on or in the working face. Due to the fact that the displaceable platform carries at least two track walling devices each mounted to be separately displaceable relative to the platform, the positions of the individual walling devices can be separately adjusted, thus enabling the track walling devices to be each individually moved from a parking position into an operating position, and back from the operating position into the parking position.

In a preferred manner, the displaceably mounted track walling devices comprise at least two track walling devices of different types. It is thus possible to take into account different circumstances during track walling and, in particular, carry along further track walling devices on the machine frame besides the anchor drilling and setting devices usually arranged on a heading or extraction machine, whereby also these track walling devices will be ready for operation and available in positions adjacent the working face. In this context, it is provided in a preferred manner that one of the track walling devices is formed by an anchor drilling and setting device and a further one of the track walling devices is formed by an operator stand fixed to a support arm, and/or a shotcrete manipulator. Such a combination of track walling devices allows for the application of shotcrete immediately after the setting of anchors, for instance on the roof, in order to provide additional track safety. The operator stand in this case is fixed to a preferably extractable and pivotable support arm and optionally also carries the shotcrete manipulator. An operator in the operator stand can thus take the necessary measures in a position immediately adjacent the anchor drilling and setting device, wherein the shotcrete manipulator is usually operated from a more remote location. The operator stand is also suitable for controlling and monitoring possible further walling measures such as, for instance, the insertion of walling frames. By the support arm being displaceably mounted on the platform along with the shotcrete manipulator, the shotcrete can be applied over a length corresponding to the displacement range, wherein the position of the heading and extraction machine itself need not be changed for this purpose.

According to a preferred further development, a further track walling device is formed by a manipulation device for walling elements and, in particular, walling arches, the manipulation device for walling elements preferably comprising a pivot mechanism for pivoting walling elements from the rear side of the machine to the mounting site. In this respect, walling elements may, for instance, be provided in the form of walling frames or walling arches, which are kept in stock behind the heading or extraction machine during heading and, among other things, serve to support the track. Due to the fact that the movable platform of the heading and extraction machine comprises a pivot mechanism for pivoting walling elements from the rear side of the machine to the mounting site, prepared and partially mounted walling arches can be readily transported to a place located nearer to the working face for the purpose of supporting the roof.

In order to enable as large a number of track walling devices to be arranged on the movable platform provided according to the invention and, in particular, to be displaceably arranged on said platform, an accordingly large number of displacement means are naturally required on the platform. Since, on the other hand, the individual track walling devices will not necessarily be used all at the same time, it may be proceeded, in the context of a preferred further development of the invention, such that at least two track walling devices are arranged on the platform, on a common displaceable console. It may, in particular, be provided that the support arm for the operating stand and/or the shotcrete manipulator, and the manipulation device for walling elements are arranged on a common displaceable console.

In a particularly simple manner, the configuration is preferably devised such that the displaceable mounting of the track walling devices is formed by at least two slide guides, wherein the displacement paths of the at least two track walling devices mounted to be displaceable relative to the platform advantageously extend parallel to each other and preferably in the longitudinal direction of the machine. The fact that the displacement paths extend in the longitudinal direction of the machine enables particularly advantageous positioning of the track walling devices, wherein both positioning near the working face and positioning remote from the working face are feasible.

The displacement drive used for displacing the track walling devices relative to the platform in this case is preferably formed by at least one chain drive. Chain drives have proved to be particularly reliable and advantageous in this context.

During the advancement of the heading or extraction machine, and during its displacement within the track, the heading or extraction machine has to be maneuverable to a sufficient extent, wherein the dimensions of the heading or extraction machine will be increased in the vertical, longitudinal and transverse directions by the track walling devices being arranged on the movable platform, particularly if the latter are accordingly large-structured, thus rendering maneuvering difficult. To remedy this, the configuration is preferably further developed to the effect that the at least two track walling devices are configured to be pivotable from an operating position into a parking position in which the track walling devices are located substantially within the outline of the heading or extraction machine. Due to the pivotable mounting of the track walling devices, the latter can be suitably swung in and brought into a position located within the outline of the heading or extraction machine. Such swinging-in also enables an accordingly large reduction of the space required in the vertical direction, thus enhancing maneuverability.

In order to arrange at least two track walling devices on the movable platform, a suitable minimum size of the platform must, of course, be provided. In this context, the configuration is preferably further developed such that the platform displaceable in the longitudinal direction of the machine has dimensions such that, in the retracted position, it reaches substantially from the rear end of the machine to the pivot arm for the extraction tools in the longitudinal direction of the machine, and occupies at least one half, preferably ⅔, of the machine width in the transverse direction. The platform thus occupies the major portion of the upper surface of the heading or extraction machine.

In the following, the invention will be explained in more detail by way of an exemplary embodiment schematically illustrated in the drawing. Therein, FIG. 1 is a perspective overall view of a heading or extraction machine according to the present invention, in which the platform is in a position displaced relative to the working face;

FIG. 2 is a perspective view with the platform retracted and the track walling devices swung in;

Figure 1:
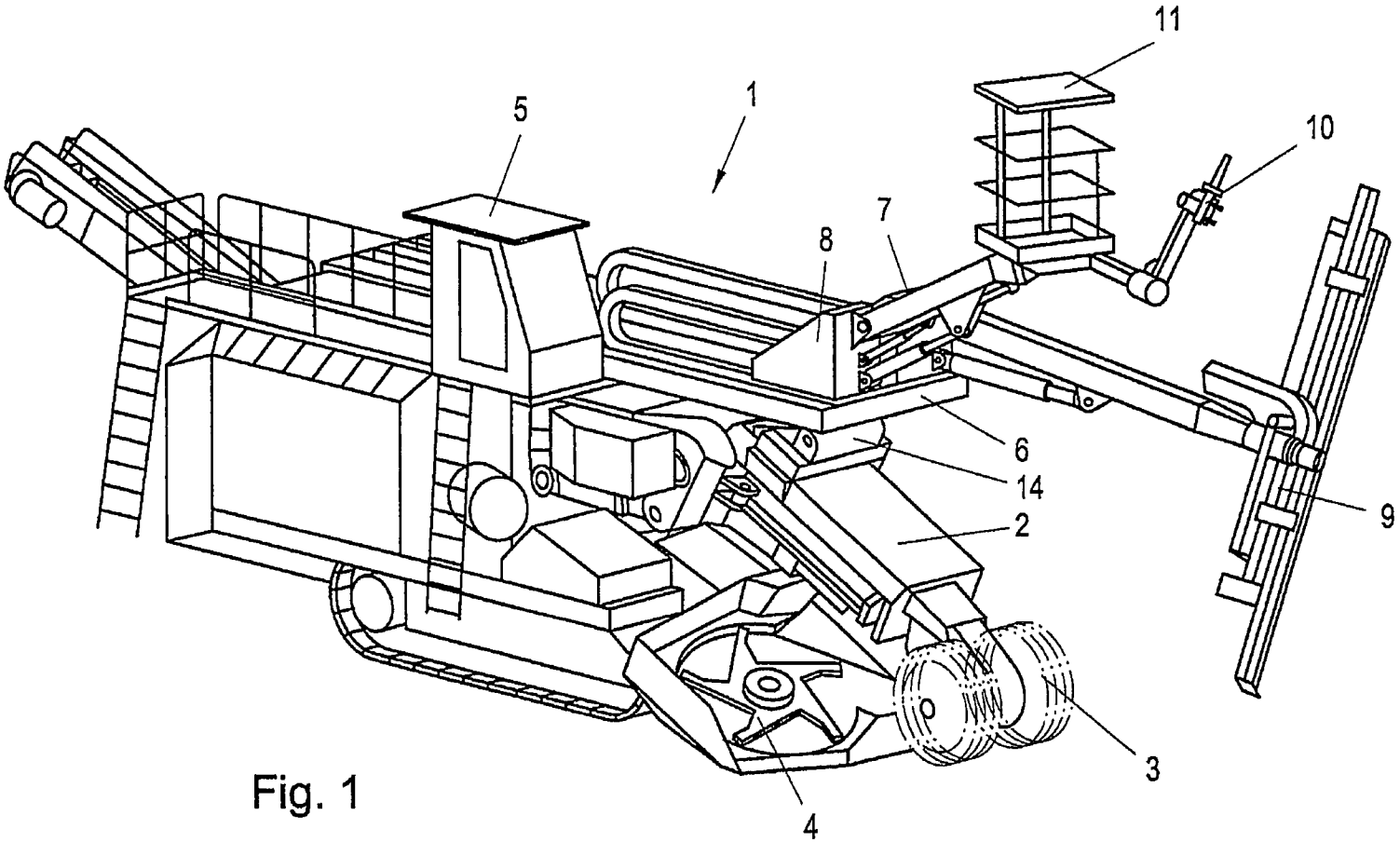

In FIG. 1, a heading or extraction machine according to the present invention, in which extraction tools 3 are attached to a cantilever arm 2, is denoted by 1. By 4 are denoted haulage means for the extracted material, which is delivered to a stationary haulage device formed, for instance, by a belt or chain conveyor, on the rear end of the machine. The heading or extraction machine 1 is controlled by an operator from a cabin 5. By 6 is denoted a platform, on which two carriages 7 and 8 are displaceable independently of each other, for instance by the aid of chain drives. The platform 6, along with the carriages 7 and 8 displaceable on it, is in turn movable relative to the heading or extraction machine 1 in the longitudinal direction of the machine and, in the position displaced to the working face, is supported on a slide bearing arranged on a cantilever arm 2. Track walling devices comprised of anchor drilling and setting devices 9 as well as an operating stand 11 and a shotcrete manipulator 10 are attached to the carriages 7 and 8, respectively.

Figure 2:
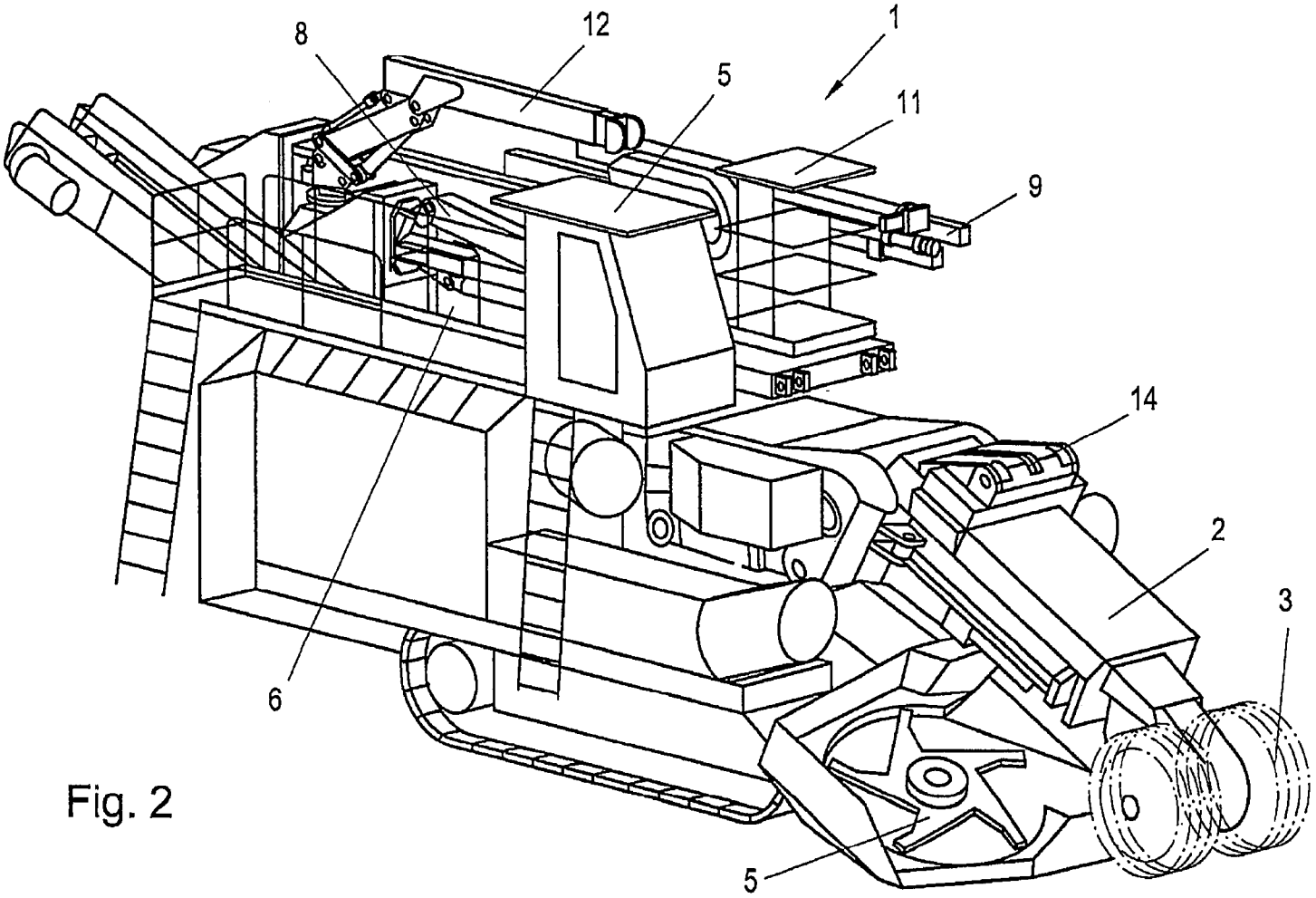

FIG. 2 depicts the machine of FIG. 1 in a position in which the platform 6 is retracted to the rear end of the heading or extraction machine. In this position, the extraction tools 3 can be moved over the working face by the aid of the cantilever arm without involving the risk of colliding with the superstructure of the platform 6, while cutting the material to be extracted or won.

Figure 3:
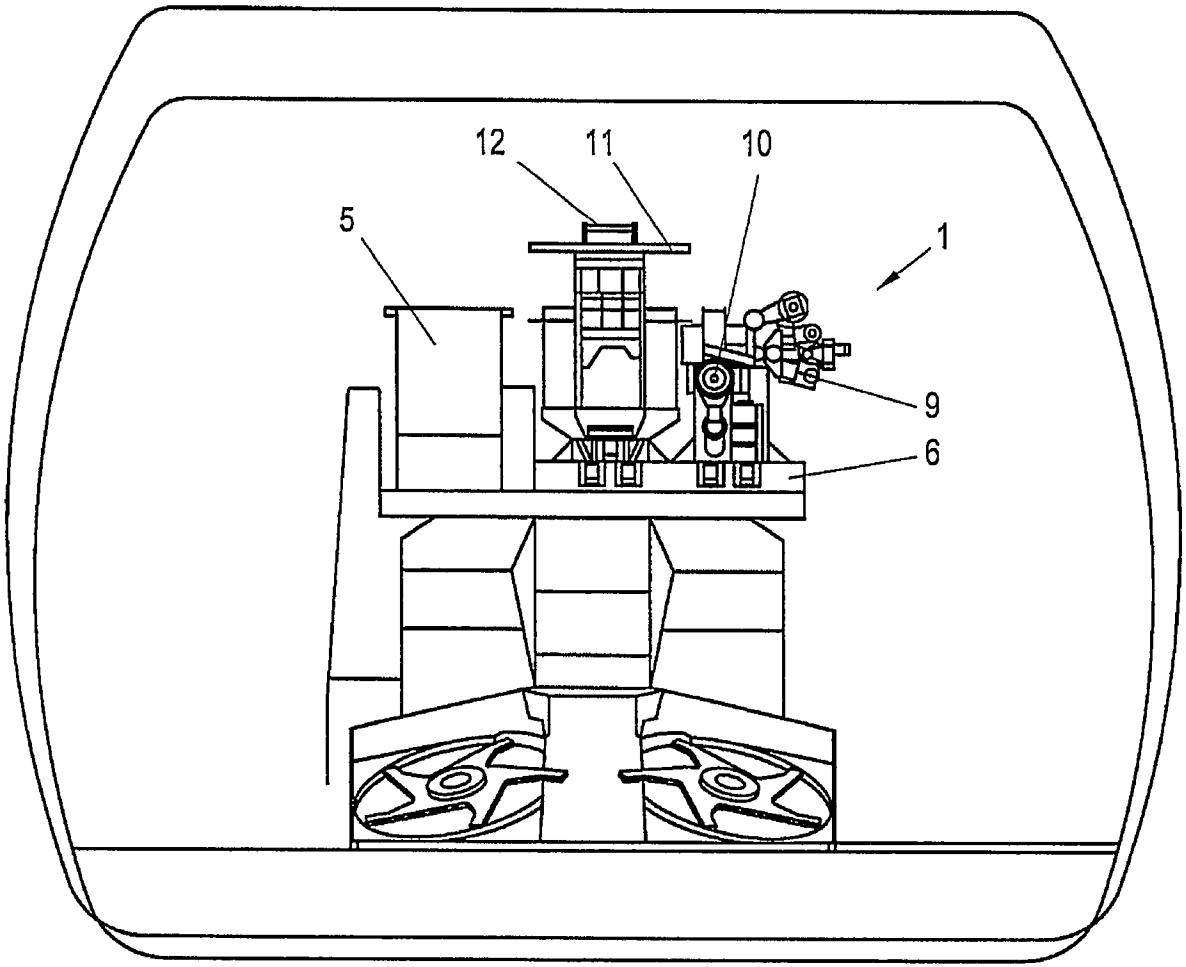
FIG. 3 is a front view of the heading or extraction machine with swung-in track walling devices.

From FIG. 3, it is apparent that the track walling devices, in the swung-in position, do not substantially project beyond the outline of the heading or extraction machine such that the confined space conditions usually prevailing in a drift when moving a machine will be accounted for.

Figure 4:
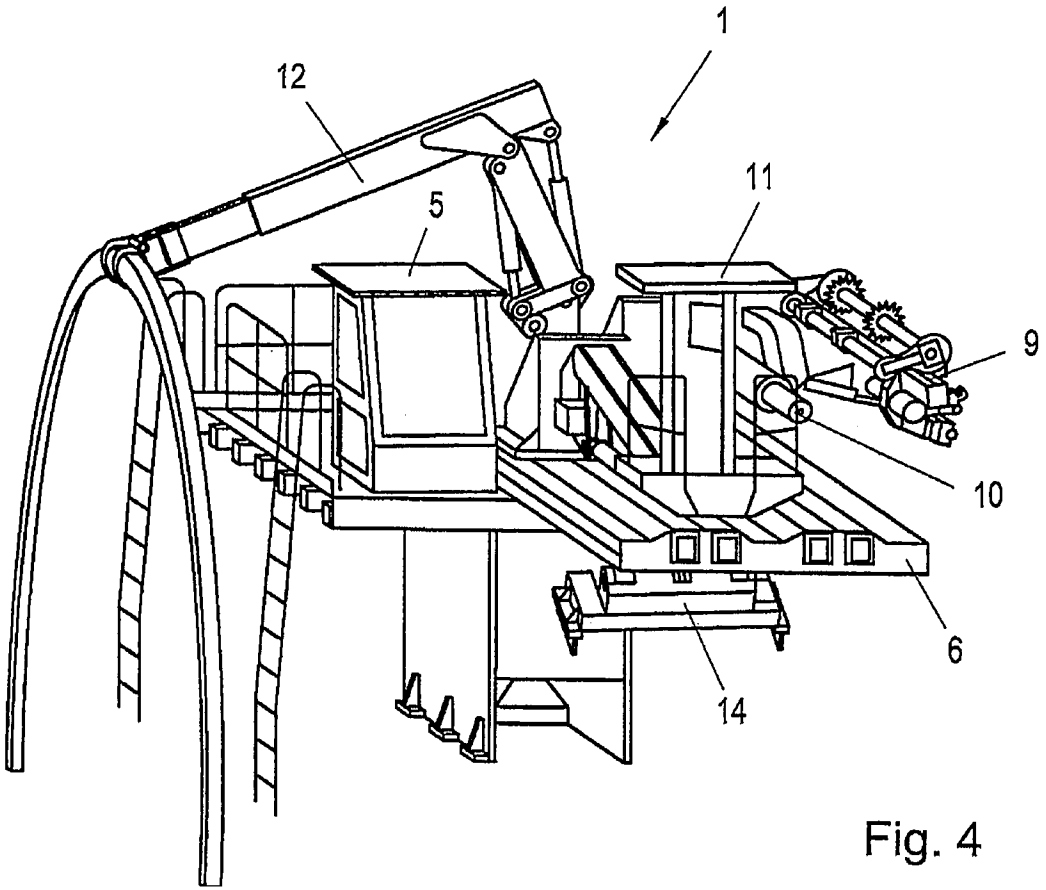
FIG. 4 is a perspective detailed view of the platform superstructure including a pivot mechanism.

As illustrated in FIG. 4, a pivot mechanism 12 may be mounted on a carriage 7 or 8 in addition to the track walling devices to transfer walling elements such as walling arches from the rear side of the machine to the mounting site. Even the pivot mechanism 12 can be moved into a parking position, as is illustrated in FIG. 2.

Figure 5:
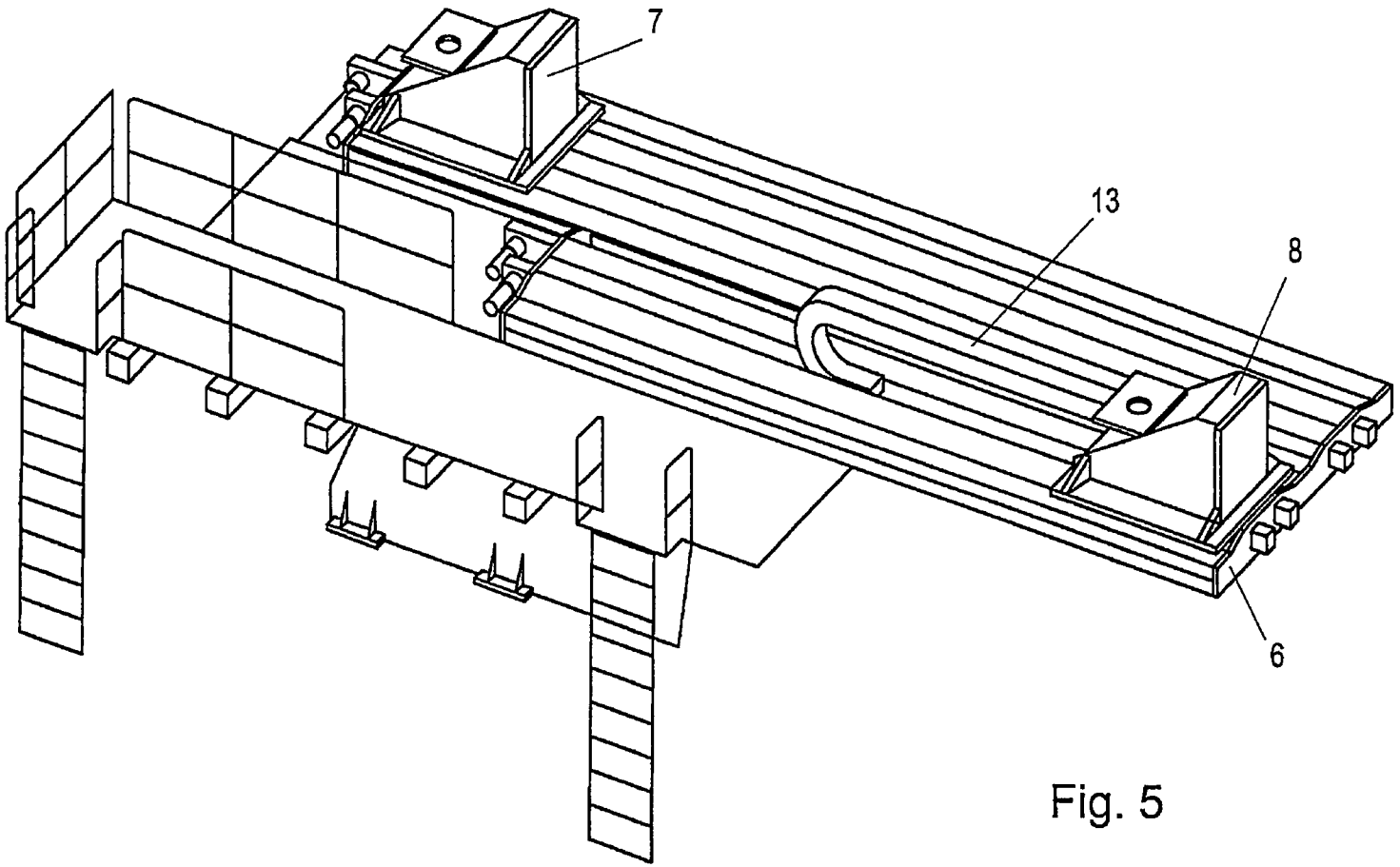
FIG. 5 is a perspective detailed view of the slide guides for the track walling devices.

From FIG. 5, it is apparent that the carriages 7 and 8 are guided in slide guides of the platform 6, with hydraulic and electric connections for the track walling devices being carried along in cable guides 13.

The invention claimed is:

1. A heading or extraction machine including extraction tools that are movable over a working face, wherein the machine comprises a platform (6) that is displaceable in a longitudinal direction of the machine relative to the machine and carries at least two track walling devices each mounted to be separately displaceable relative to the platform (6) along a displacement path, wherein the displacement paths of the at least two track walling devices extend parallel to each other and in the longitudinal direction of the machine.

2. A heading or extraction machine according to claim 1, wherein the at least two displaceably mounted track walling devices comprise at least two different types of track walling devices.

3. A heading or extraction machine according to claim 2, wherein a first one of the track walling devices is an anchor drilling and setting device (9), and a second one of the track walling devices is fixed to a support arm, and is an operator stand (11) or a shotcrete manipulator (10).

4. A heading or extraction machine according to claim 3, wherein a further track walling device is a manipulation device for walling elements.

5. A heading or extraction machine according to claim 4, wherein the manipulation device for walling elements comprises a pivot mechanism (12) for pivoting walling elements from a rear side of the machine to a mounting site for the walling elements.

6. A heading or extraction machine according to claim 4, wherein the support arm for the operating stand (11) or the shotcrete manipulator (10), and the manipulation device for walling elements, are arranged on a common displaceable console.

7. A heading or extraction machine according to claim 1, wherein displaceable mounting of the track walling devices comprises at least two slide guides.

8. A heading or extraction machine according to claim 1, wherein the at least two track walling devices are configured to be pivotable from an operating position into a parking position in which the track walling devices are located substantially within an outline of the heading or extraction machine (1).

9. A heading or extraction machine according to claim 1, wherein the platform (6) displaceable in the longitudinal direction of the machine is dimensioned such that, in a retracted position, the platform (6) reaches substantially from a rear end of the machine to a pivot arm for the extraction tools in the longitudinal direction of the machine, and the platform (6) occupies at least one half of a width of the machine in a transverse direction of the machine.

10. A heading or extraction machine according to claim 1, further comprising an operator cabin mounted to be displaceable in the longitudinal direction of the machine.

11. A heading or extraction machine according to claim 1, further comprising a displacement drive used for displacing the track walling devices relative to the platform (6), said displacement drive comprising at least one chain drive.

12. A heading or extraction machine according to claim 1, wherein the platform (6) displaceable in the longitudinal direction of the machine is dimensioned such that, in a retracted position, the platform (6) reaches substantially from a rear end of the machine to a pivot arm for the extraction tools in the longitudinal direction of the machine, and the platform (6) occupies at least two-thirds of a width of the machine in a transverse direction of the machine.

13. A heading or extraction machine according to claim 2, wherein displaceable mounting of the track walling devices comprises at least two slide guides.

14. A heading or extraction machine according to claim 3, wherein displaceable mounting of the track walling devices comprises at least two slide guides.

15. A heading or extraction machine according to claim 4, wherein displaceable mounting of the track walling devices comprises at least two slide guides.

16. A heading or extraction machine according to claim 2, wherein the at least two track walling devices are configured to be pivotable from an operating position into a parking position in which the track walling devices are located substantially within an outline of the heading or extraction machine (1).

17. A heading or extraction machine according to claim 3, wherein the at least two track walling devices are configured to be pivotable from an operating position into a parking position in which the track walling devices are located substantially within an outline of the heading or extraction machine (1).

18. A heading or extraction machine according to claim 4, wherein the at least two track walling devices are configured to be pivotable from an operating position into a parking position in which the track walling devices are located substantially within an outline of the heading or extraction machine (1).

* * * * *